US007036976B1

(12) United States Patent
Andersson

(10) Patent No.: US 7,036,976 B1
(45) Date of Patent: May 2, 2006

(54) DEVICE AND METHOD FOR CONTINUOUS MIXING OF AT LEAST TWO COMPONENTS

(75) Inventor: Alf Andersson, Odakkra (SE)

(73) Assignee: Global Power AB, Taby (SE)

( * ) Notice: Subject to any disclaimer, the term of this patent is extended or adjusted under 35 U.S.C. 154(b) by 0 days.

(21) Appl. No.: 09/868,729

(22) PCT Filed: Dec. 16, 1999

(86) PCT No.: PCT/SE99/02385

§ 371 (c)(1),
(2), (4) Date: Jun. 21, 2001

(87) PCT Pub. No.: WO00/37164

PCT Pub. Date: Jun. 29, 2000

(30) Foreign Application Priority Data

Dec. 21, 1998 (SE) ..... 9804442

(51) Int. Cl.
*B01F 7/16* (2006.01)

(52) U.S. Cl. ..... 366/294; 366/295; 366/296; 366/310

(58) Field of Classification Search ..... 366/96, 366/97, 168.1, 172.1, 172.2, 176.1, 176.2, 366/178.1, 178.2, 293–296, 310
See application file for complete search history.

(56) References Cited

U.S. PATENT DOCUMENTS 2,441,711 A * 5/1948 McFadden
3,271,194 A * 9/1966 Oikawa
3,308,171 A * 3/1967 Oikawa
3,318,579 A * 5/1967 Foucault
3,357,798 A * 12/1967 Yamashita
4,883,363 A * 11/1989 Pillon et al.
4,889,428 A * 12/1989 Hodson
2001/0036125 A1 * 11/2001 Bachelier et al.

FOREIGN PATENT DOCUMENTS

DE 41 28 999 C2 6/1993
EP 0048312 A1 3/1982
JP 2-6860 * 1/1990

* cited by examiner

*Primary Examiner*—Charles E. Cooley
(74) *Attorney, Agent, or Firm*—Browdy and Neinark, PLLC

(57) ABSTRACT

A device for continuous mixing of at least two components, such as liquids and/or powders. The device comprises first elements for joining the components in layers, and second elements for discharging the joined components during simultaneous deformation of a layer structure obtained in the joining, to provide a homogeneous mixture of components. The first elements include a layering element and a receiving element rotatable about a longitudinal axis and having a receiving surface which faces the layering element and is arranged radially outside the same. The layering element is adapted to alternately dispose the components to be mixed in the form of thin layers on the receiving surface to form a stratum of layer structure, and the receiving element is during rotation adapted to support the stratum. The present invention also relates to a method for continuous mixing of at least two components.

18 Claims, 4 Drawing Sheets

DEVICE AND METHOD FOR CONTINUOUS MIXING OF AT LEAST TWO COMPONENTS

REFERENCE TO RELATED APPLICATIONS

The present application is the national stage under 35 U.S.C. §371 of international application PCT/SE99/02385, filed Dec. 16, 1999 which designated the United States, and which application was published in the English language.

TECHNICAL FIELD

The present invention relates to a device and a method for mixing components, more specifically a device for continuous mixing of at least two components, such as liquids and/or powders, comprising a first means for joining the components in layers, and a second means for discharging the joined components during simultaneous deformation of a layer structure, obtained in the joining, to provide a homogeneous mixture of components, as well as a corresponding method for continuous mixing of at least two components.

BACKGROUND ART

The most common method of mixing components, such as liquids and/or powders, is to join the components in a vessel and agitate them. This method, however, is not suited for continuous mixing, and moreover the mixing will be random, thereby making it impossible to ensure a homogeneous mixture of components. The result will be largely dependent on the disposition of the components towards mixing.

According to another method, separate partial flows of components are joined to form a common flow, which is then subjected to turbulence. This method certainly admits continuous mixing, but also in this case the mixing will be random and dependent on the disposition of the components towards mixing.

With a view to solving these problems, a method has been developed, which allows continuous and satisfactory mixing of components, and also mixing of components which are not disposed to be mixed. According to this method, the components are joined in layers, and the thus-joined components are then conveyed during deformation of the layer structure obtained in connection with the joining. As a result, a continuous and homogeneous mixture of components can be obtained.

DE 41 28 999 discloses a device which uses the latter method. The device allows mixing of two components and comprises two annular, narrow ducts, one for each component. The ducts are arranged opposite each other and join each other in a narrow gap. The components are supplied through a duct each, at a relatively high pressure, and are joined in the form of annular layers in the gap, from where the thus-joined components are conducted through one more duct. While flowing in the latter duct, the layer structure obtained in joining is deformed, and a homogeneous mixture of components is obtained. The device allows continuous mixing of components which are not disposed to be mixed, such as oil and water, the oil being supplied at higher pressure than the water to form a dispersion.

However, the device suffers from a number of drawbacks. First, the device does not allow mixing of more than two components. Moreover, the device will not allow mixing of anything but liquid components.

OBJECT AND SUMMARY OF THE INVENTION

A first object of the present invention therefore is to provide a device which allows continuous mixing of two or more components, which components can be liquids and/or powders. Liquids are intended to comprise also thixotropic and other viscous materials.

A second object of the invention is to provide a method for continuous mixing of two and more components, such as liquids and/or powder. Liquids are again intended to comprise also thixotropic and other viscous materials.

According to the invention, the first object is achieved by a device for continuous mixing.

According to the invention, the second object is achieved by a method for mixing at least two components.

More specifically, the invention provides a device for continuous mixing of at least two components, such as liquids and/or powders, comprising a first means for joining the components in layers, and a second means for discharging the joined components during simultaneous deformation of a layer structure, obtained in the joining, to provide a homogeneous mixture of components, said device being characterised in that the first means comprises a layering means and a receiving means rotatable about a longitudinal axis and having a receiving surface facing the layering means and being arranged radially outwardly of the layering means, the layering means being adapted to alternately dispose the components in the form of thin layers on the receiving surface to form a stratum of layer structure, and the receiving means, while rotating, being adapted to support said stratum.

The mixing ratio of the components is already determined when joining the components, and thus the mixing ratio is very easy to control by controlling each flow of components to the layering means.

Furthermore, the number of components is not restricted to two, nor it is necessary for the components to be liquid.

By varying the longitudinal extension of the layers of components, i.e. by varying the angular velocity of the receiving means relative to the layering means, the mixing intensity may be varied. A high relative angular velocity between the layering means and the receiving means results in a high mixing intensity, which allows mixing of components which are not disposed to be mixed. This allows, for example, continuous mixing of thixotropic components, such as soft whey-cheese and ordinary soft cheese, which are not disposed to be mixed.

Moreover, continuous mixing of components in various phases is allowed, thereby allowing, for example, mixing of one component in liquid form and one component in pulverulent form.

Said second means acts as stated above to discharge the joined components during simultaneous deformation of the layer structure obtained in joining. A method of achieving this is to let the second means mechanically engage with the layer structure for advancing and for performing a creasing thereof. The second means can also be arranged to conduct the layer structure in a duct while flowing turbulently, which also results in creasing of the layer structure, thus ensuring a homogeneous mixture of components.

The layering means can be rotatable about said longitudinal axis, and preferably the layering means is rotatable with a first angular velocity and the receiving means is rotatable with a second angular velocity differing from the first angular velocity. Moreover, the layering means is advantageously rotatable in a direction of rotation which is opposite to the direction of rotation in which the receiving means is rotatable. This makes it possible to reach a high relative angular velocity between the layering means and the receiving means, which thus allows mixing of components which are not disposed to be mixed.

Preferably, the layering means is rotatable with an angular velocity in the range 30–85 rad/s, and the receiving means is rotatable with an angular velocity in the range 30–85 rad/s.

The layering means may comprise a nozzle for each of the components, each nozzle being adapted to dispose thin layers of the component supplied thereto on the receiving surface.

The layering means can alternatively comprise a blade means which is rotatable about said longitudinal axis and which during rotation thereof is adapted to engage with the components supplied thereto and subsequently throw them away to dispose thin layers of the components on the receiving surface.

According to a first preferred embodiment of the invention, the receiving means is adapted to transfer the stratum to the second means, and more specifically the receiving means may comprise a body having a conical interior circumferential surface which is concentrically arranged about the longitudinal axis and which thus encloses the layering means and forms said receiving surface, the receiving means, during rotation thereof and under the action of centrifugal forces, being adapted to conduct said stratum towards the wider end of the conical receiving surface, at which end the stratum will be transferred to the second means.

In operation of a thus designed device in which the wider end of the receiving surface is directed downwards, joining of liquid components is allowed. The rotation of the receiving means thus causes centrifugal forces which support the stratum, formed of the components, on the receiving surface and at the same time ensure that the stratum is continuously conducted towards the wider end of the receiving surface to be transferred to the second means. One or more components can also be pulverulent.

Preferably, the second means comprises a helical duct which encloses the receiving means and has a side open towards the receiving means, whereby the stratum continuously transferred from the receiving means will be collected by said duct. The second means may further comprise in unison with the receiving means rotatable discharge means, and the duct may comprise an outlet connected thereto, the discharge means being adapted to convey to the outlet the stratum transferred to the duct during deformation of its layer structure. Preferably each discharge means comprises a vane which is fixed in the receiving means and displaceable in the duct and which during rotation of the receiving means engages with the stratum transferred to the duct and conveys it during creasing thereof towards the outlet.

According to a second preferred embodiment of the inventive device, the second means comprises a scraper element for scraping off the stratum from the receiving surface, and the receiving means is adapted to transfer, during rotation, the thus-scraped off stratum to a discharge unit of the second means.

Preferably the receiving means comprises a body having a cylindrical, interior circumferential surface which is concentrically arranged about the longitudinal axis and which thus encloses the layering means and forms said receiving surface, and the scraper element is arranged along the receiving surface to scrape off the stratum, said deformation of the stratum being performed during said scraping off.

This allows mixing of pulverulent components, the stratum formed of the components being supported on the receiving surface owing to the centrifugal forces acting on the stratum by means of the rotation of the receiving means.

The scraper element preferably comprises a helical band element which is extended parallel with the longitudinal axis and which is arranged along the cylindrical receiving surface, the band element being rotatable with a third angular velocity differing from said second angular velocity, whereby the stratum formed on the receiving surface, during rotation of the receiving means as well as the band element, is continuously conveyed to a discharge position, from which the stratum will be transferred to the discharge unit of the second means.

Moreover, the present invention provides a method for mixing at least two components, comprising the steps of joining the components in layers, and subsequently conveying the thus-joined components in such manner that a layer structure obtained in the joining is deformed to form a homogeneous mixture of components, said method being characterised in that the step of joining the components comprises the steps of alternately disposing, with the aid of a layering means, thin layers of the components on a receiving means radially enclosing the layering means to form a stratum of layer structure, and by rotation of the receiving means supporting the stratum, the layers in the circumferential direction being disposed uniformly on the receiving means in consequence of its rotation.

Preferably the receiving means is rotated with a first angular velocity and the layering means is rotated with an angular velocity differing from the angular velocity of the receiving means, whereby the layering means engages with components supplied thereto and throws them in the form of thin layers to the receiving means.

A preferred embodiment of the invention will now for the purpose of exemplification be described with reference to the accompanying Figures.

DESCRIPTION OF EMBODIMENTS

Figure 1:
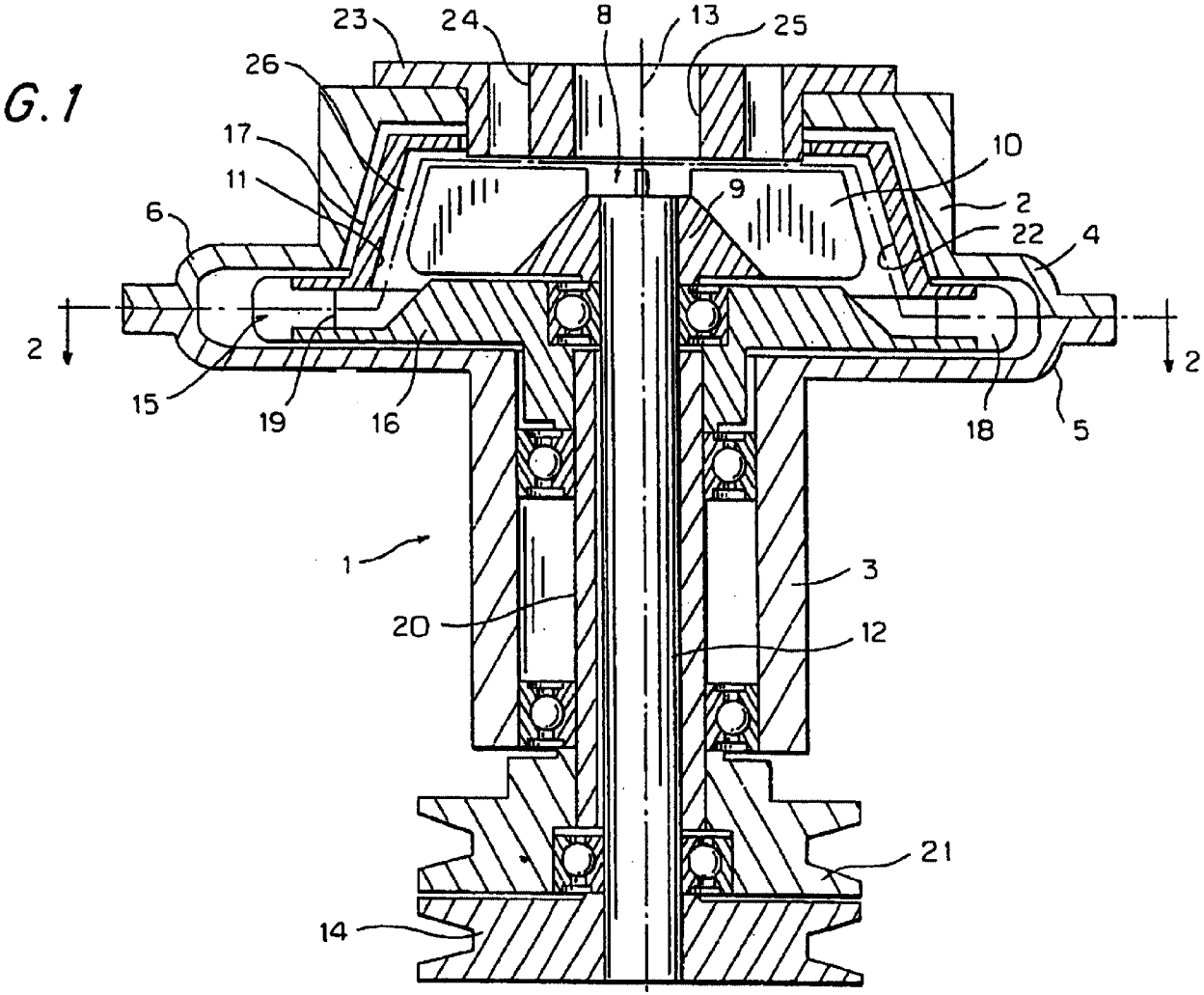
FIG. 1 is a cross-sectional view of a first embodiment of a device according to the invention.
Figure 2:
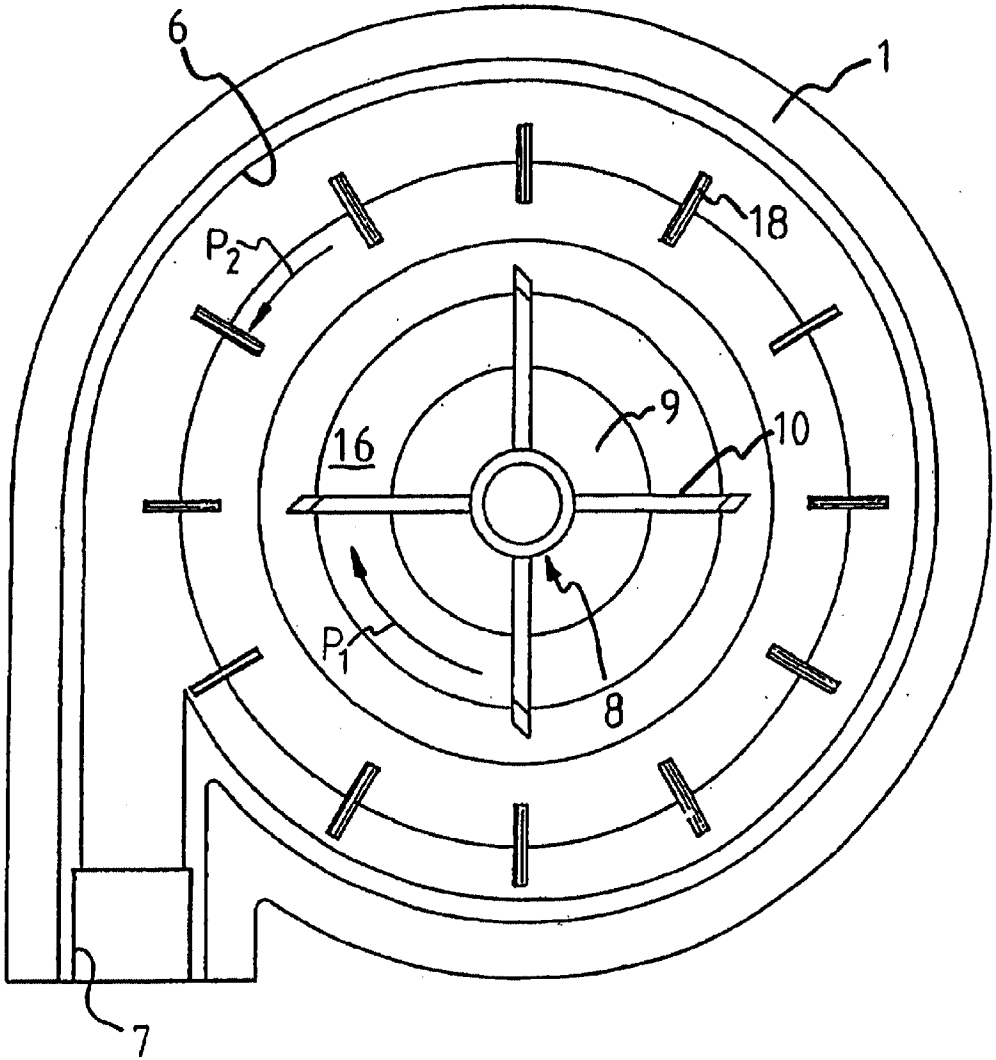
FIG. 2 is a cross-sectional view of the device along line 2—2 in FIG. 1.

A device as shown in FIGS. 1 and 2, to which reference is made, for continuous mixing according to a first embodiment of the present invention comprises a housing 1, in which a first means for joining components in layers and a second means for discharging the joined components during simultaneous deformation of a layer structure obtained in the joining are arranged. The first means comprises more specifically a layering means and a receiving means which are concentrically arranged in the housing 1. The second means comprises a helical duct 6 and vane means 18.

The housing 1 comprises an upper housing portion 2 and a lower housing portion 3. The upper housing portion 2 is open at both ends and has a lower flange 4. The lower housing portion 3 is also open at both ends and has an upper flange 5. The flanges 4, 5 abut each other and form the helical duct 6. An outlet pipe 7 shown in FIG. 2 is tangentially connected to the duct 6.

The layering means comprises a layering rotor 8 arranged concentrically in the housing 1 and having a hub 9, which supports four blades 10 arranged perpendicularly to each other. The hub 9 is attached to a first end of a first drive shaft 12 which extends along a central longitudinal axis 13 of the housing 1. A first pulley 14 is fixed to the second end of the first drive shaft 12.

The receiving means comprises a receiving rotor 15 arranged concentrically in the housing 1 and having an essentially planar lower part 16 and a conical upper part 17, the wider end 11 of the upper part 17 being directed downwards. The upper part 17 is supported by the lower part 16 with the aid of the vane means 18 to form an annular gap 19 between the two parts 16, 17. The lower part 16 is fixed to a first end of a second drive shaft 20 which is hollow and extends outside the first drive shaft 12 along the longitudinal axis 13. The second end of the second drive shaft 20 supports a second pulley 21. The lower part 16 and the second pulley 21 are mounted in bearings in the first drive shaft 12.

The two pulleys 14, 21 are, via belts (not shown), connected to drive means (not shown).

The receiving rotor 15 is arranged in the housing 1 in such manner that a conical interior circumferential surface 22 of the receiving rotor 15 radially encloses the layering rotor 8.

Thus the two rotors 8, 15 are mutually concentric and rotatable relative to each other by means of the first and the second drive shaft 12, 20, respectively.

Furthermore, the second drive shaft 20 is mounted in bearings in the housing 1. Finally a cover 23 with supply openings 24, 25 is mounted in the upper side of the upper housing portion 2.

In operation of the device, the layering rotor 8 and the receiving rotor 15 are driven with the aid of the drive means (not shown). The rotors 8, 15 are rotated with different angular velocities $\omega_1$ and $\omega_2$, respectively, and preferably in different directions of rotation $P_1$ and $P_2$, respectively. An example of merely exemplifying angular velocities $\omega_1$ and $\omega_2$ is 30–85 rad/s for each rotor 8, 15. However, it will be appreciated that the angular velocities $\omega_1$ and $\omega_2$ must be adjusted to the components to be mixed, which means that certain components may require both lower and higher angular velocities.

The components to be mixed are supplied to the device through the supply openings 24, 25. Suitably liquid components are supplied through the narrower supply openings 24 and pulverulent components, if any, are supplied through the wider supply opening 25.

The components are conducted to a space 26 which is defined in the housing 1 and in which the blades 10 of the layering rotor 8 are arranged. During rotation, the blades 10 will thus engage with the supplied components and throw thin layers of each component tangentially forwards (seen perpendicular to the plane of rotation of the layering rotor). The thin layers will be collected by and disposed on the interior circumferential surface 22 of the receiving rotor 15. The layers will be disposed essentially alternately and thus form a stratum of layer structure.

The stratum is supported by the receiving rotor 15 owing to its rotation. Moreover, the conical design of the circumferential surface 22 implies that the centrifugal forces acting on the stratum continuously conduct the stratum towards the wider end 11 of the circumferential surface 22. As the stratum reaches this end 11, it will be thrown away through the annular gap 19 and collected by the helical duct 6.

The vane means 18 are arranged in the helical duct 6 and rotate in unison with the receiving rotor 15. The vane means 18 will thus travel in the same duct 6 and engage with the stratum arranged in the duct 6. The stratum is conveyed by the vane means 18, during simultaneous deformation or creasing thereof, to the outlet 7. When the stratum finally reaches the outlet 7, the stratum is consequently worked in such manner that a homogeneous mixture of components has been provided. The second means, i.e. the duct 6 and the vane means 18, thus serves to discharge the stratum having a layer structure while creasing the same by mechanical engagement.

If any of the components is a pulverulent component, it is supplied, as described above, through the wider supply opening 25. The supply opening 25 is arranged essentially centrally in the cover 23. This ensures that the blades 10 of the layering rotor 8 first dispose layers of liquid components, which consequently are supplied through the smaller and radially externally arranged supply openings 24, and subsequently dispose layers of the pulverulent component on the circumferential surface 22. This results in wetting of the circumferential surface 22, which facilitates the disposing of powder layers.

It will be appreciated that the directions of rotation $P_1$, $P_2$ of the rotors 8, 15 need not necessarily be opposed. The essential thing is that the requisite relative angular velocity between the rotors 8, 15 is achieved, the requisite relative angular velocity being dependent on the desired mixing intensity. A high relative angular velocity results in the layers being extended in the longitudinal direction, which results in a high mixing intensity.

Thanks to the relative angular velocity between the rotors 8, 15 the layers of components will be disposed uniformly in the circumferential direction on the interior circumferential surface 22 of the receiving rotor 15, even if differences in intensity in the angular direction should arise in the flow of components from the layering rotor 8.

Figure 3:
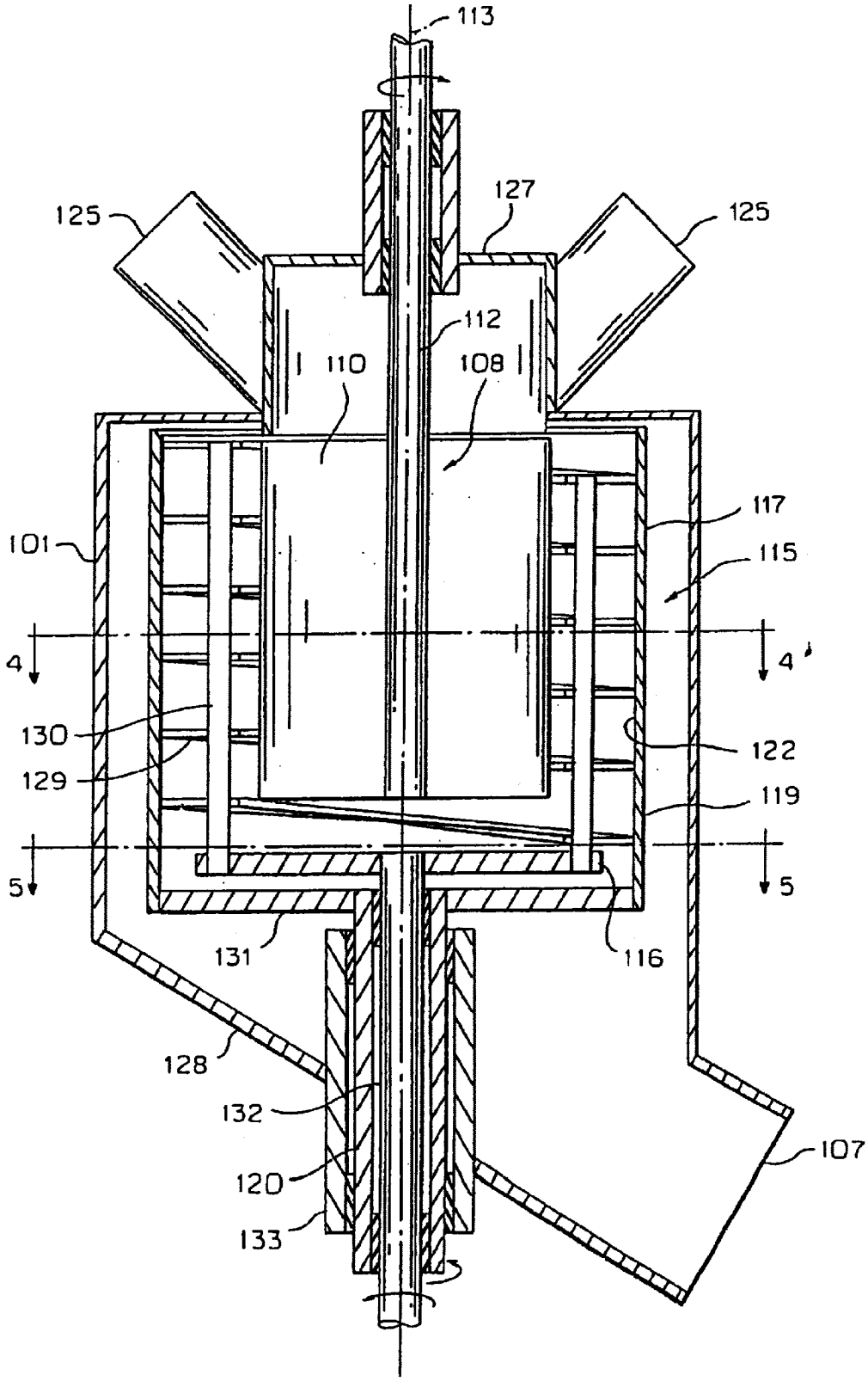
FIG. 3 is a cross-sectional view of a second embodiment of a device according to the present invention.
Figure 4:
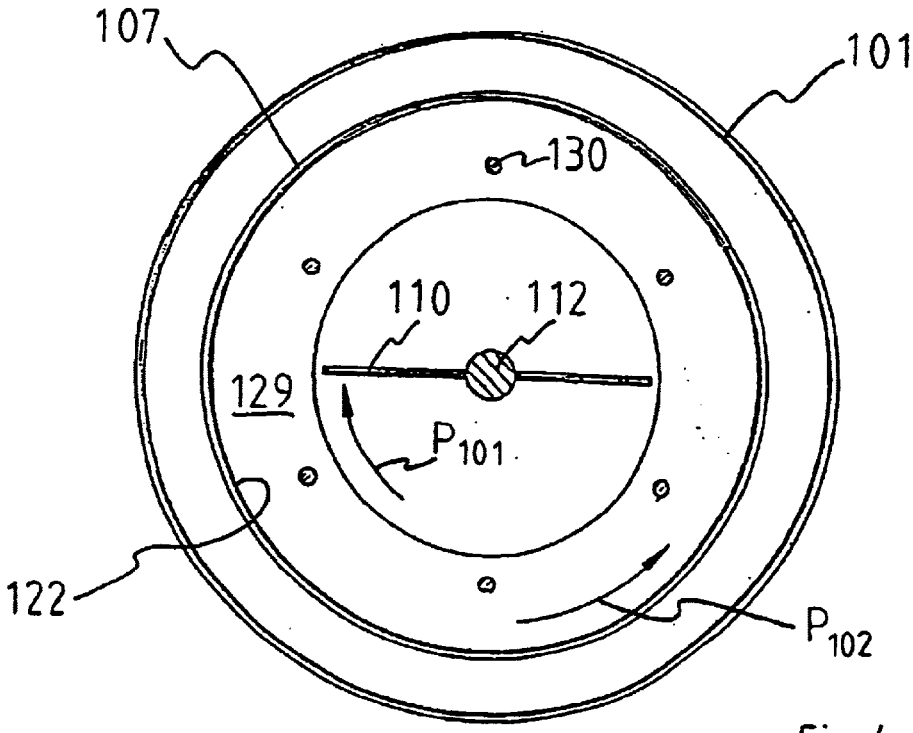
FIG. 4 is a cross-sectional view of the device along line 4—4 in FIG. 3.
Figure 5:
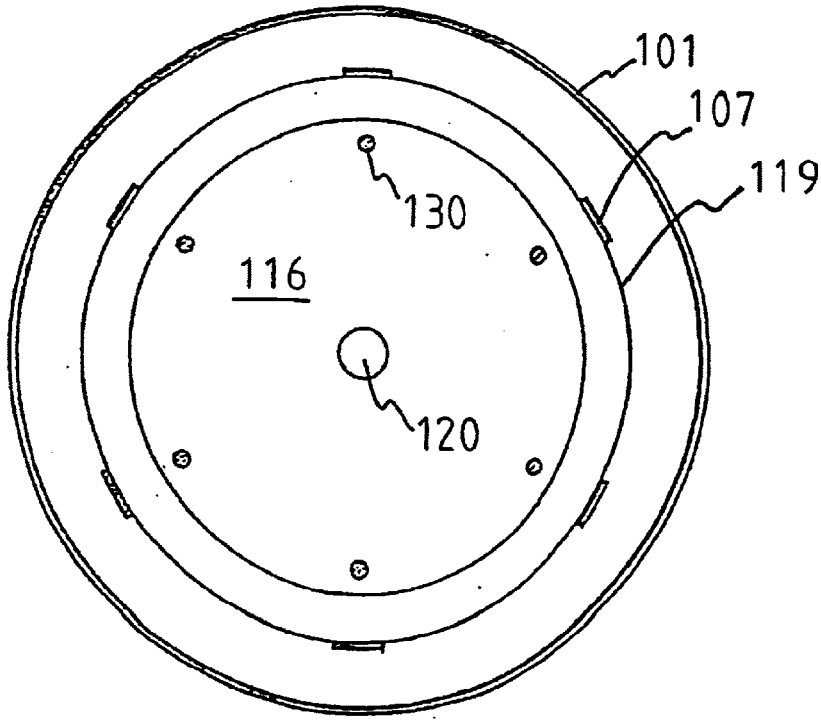
FIG. 5 is a cross-sectional view of the device along line 5—5 in FIG. 3.

FIGS. 3–5, to which reference is made, illustrate a device for continuous mixing according to a second preferred embodiment of the present invention.

The device comprises a housing 101, in which a first means for joining components in layers and a second means for discharging the joined components during simultaneous deformation of a layer structure obtained in the joining are arranged. The first means comprises more specifically a layering means and a receiving means. The second means comprises a scraper element in the form of a band element 129. The housing 101 also constitutes part of the second means. The housing 101 has supply openings 125 and an outlet 107, and the layering means and the receiving means are concentrically arranged about a longitudinal axis 113 in said housing 101.

The layering means comprises a layering rotor 108 with two blades 110 which are attached to opposite sides of a first end of a first drive shaft 112, which extends along the longitudinal axis 113 and out through the upper side 127 of the housing 101. The second end of the drive shaft 112 is via a driving assembly (not shown) connected to a drive means (not shown).

The receiving means comprises a receiving rotor 115 formed of a cylindrical part 117 which is supported by a first bottom disc 131. The cylindrical part 117 has an interior circumferential surface 122 which radially encloses the blades 110 of the layering rotor 108. The cylindrical part 117 further has circumferentially distributed openings 119 in an area in the vicinity of the bottom disc 131, which is clearly to be seen in FIG. 5. The bottom disc 131 is attached to a first end of a second hollow drive shaft 120, which is arranged concentrically with the longitudinal axis 113 and is externally mounted in bearings in a bearing part 133 in the underside 128 of the housing 101. The second drive shaft 120 extends through the underside 128 of the housing 101, and its second end is via a driving assembly (not shown) connected to a drive means (not shown).

The helical band element 129 extended parallel with the longitudinal axis 113 is arranged along the interior circumferential surface 122 of the cylindrical part 117. The band element 129 is supported by struts 130 which in turn are fixed to a second bottom disc 116 which is attached to a first end of a third drive shaft 132 which extends inside the second drive shaft 120 along the longitudinal axis 113. The third drive shaft 132 is externally mounted in bearings in the second drive shaft 120, and its second end is via a driving assembly (not shown) connected to a drive means (not shown).

The layering rotor 108, the receiving rotor 115 and the band element 129 are thus concentrically arranged about the longitudinal axis 113 and rotatable relative to each other. Preferably, the layering rotor 108 is rotatable in a first direction of rotation $P_{101}$ while the receiving rotor 115 and the band element 129 are rotatable in a second direction of rotation $P_{102}$. Moreover the band element 129 is rotatable with an angular velocity $\omega_{103}$ differing from the angular velocity $\omega_{102}$ of the receiving rotor 115.

In operation of the device, the layering rotor 108 is thus rotated in a first direction of rotation $P_{101}$ with a first angular velocity $\omega_{101}$ while the receiving rotor 115 and the band element 129 are rotated in a second direction of rotation $P_{102}$ with a second and a third angular velocity $\omega_{102}$, $\omega_{103}$, respectively.

Components, for example in pulverulent form, are supplied to the device via the supply openings 125, the blades 110 engaging with the pulverulent components and alternately disposing layers of the different components on the circumferential surface 122 of the cylindrical part 117. As a result, a stratum of layer structure forms on said circumferential surface 122. Thanks to the relative rotation between the cylindrical part 117 and the band element 129, the stratum will be scraped off from the circumferential surface 122 and conveyed to the area of the cylindrical part 117 with openings 119. During this conveyance, the layer structure of the stratum will be deformed or creased to obtain a homogeneous mixture of components. As the stratum reaches the openings 119, it will be thrown away tangentially forwards under the action of centrifugal forces. The stratum will then be collected by the housing 101 and conducted to the outlet 107, possibly while being continuously deformed or creased.

It will be appreciated that the present invention is not restricted to the embodiments illustrated.

For instance, the band element can be replaced by some other scraper element. The important thing is that the stratum formed on the circumferential surfaces is transferred to the housing and its outlet.

The second means for discharging the joined components during simultaneous deformation of the layer structure obtained in the joining operates by acting mechanically on said layer structure, said second means being described above with reference to the shown embodiments. The vane means 18 in FIGS. 1 and 2 and the band element 129 in FIGS. 3 and 4 thus engage with the layer structure and advance the same during simultaneous creasing. However, it will be appreciated that said advancing during simultaneous deformation can be carried out in other manners. For instance, the second means can be arranged to conduct the joined components in a duct while flowing turbulently. Also in this case, the layer structure will be creased, thus obtaining a homogeneous mixture of components.

Moreover, it is possible to replace the layering rotor of the first means with nozzles, which are adapted to dispose a layer of components each on the receiving rotor. The nozzles can either be stationary or rotatable.

It is also possible to turn the receiving rotor described with reference to FIGS. 1 and 2 in such manner that the wider end is directed upwards. The stratum applied to the receiving surface of the receiving rotor will in any case be conveyed to the wider end because of is the centrifugal forces acting on the stratum.

It will finally be appreciated that the number of blades of the layering rotor may vary. The number of layers of components that are disposed on the receiving means per revolution of the layering rotor is partly a function of the number of blades. Thus, the mixing intensity may be affected by varying the number of blades of the layering rotor.

The embodiments illustrated can consequently be modified and changed without departing from the scope of the invention as defined only by the appended claims.

What is claimed is:

1. A device for continuous mixing of at least two components, such as liquids and/or powders, comprising a first means (8, 15; 108, 115) for joining the components in layers, and a second means (6, 18; 101, 129) for discharging the joined components during simultaneous deformation of a layer structure, obtained in the joining, to provide a homogeneous mixture of components, wherein the first means (8, 15; 108, 115) comprises a layering means (8; 108) and a receiving means (15; 115) rotatable about a longitudinal axis (13; 113) and having a receiving surface (22; 122) facing the layering means (8; 108) and arranged radially outwardly of the same, the layering means (8; 108) being adapted to alternately dispose the components in the form of thin layers on the receiving surface (22; 122) to form a stratum of layer structure, and the receiving means (15; 115), while rotating, being adapted to support said stratum.

2. A device as claimed in claim 1, wherein the layering means (8; 108) is also rotatable about said longitudinal axis (13; 113).

3. A device as claimed in claim 2, wherein the layering means (8; 108) is rotatable in a direction of rotation ($P_1$; $P_{101}$) which is opposite to the direction of rotation ($P_2$; $P_{102}$) in which the receiving means (15; 115) is rotatable.

4. A device as claimed in claim 2, wherein the layering means (8; 108) is rotatable with a first angular velocity ($\omega_1$; $\omega_{101}$), and the receiving means (15; 115) is rotatable with a second angular velocity ($\omega_2$, $\omega_{102}$) differing from the first angular velocity (($\omega_1$, $\omega_{101}$).

5. A device as claimed in claim 4, wherein the first angular velocity ($\omega_1$; $\omega_{101}$) is in the range 30–85 rad/s.

6. A device as claimed in claim 4, wherein the second angular velocity ($\omega_2$, $\omega_{102}$) is in the range 30–85 rad/s.

7. A device as claimed in claim 2, wherein the layering means (8; 108) comprises a blade means (10; 110) which is rotatable about said longitudinal axis (13; 113) and which during rotation is adapted to engage with the components supplied thereto and subsequently throw them away to dispose thin layers of the components on the receiving surface (22; 122).

8. A device as claimed in claim 1, wherein the layering means comprises a nozzle for each of the components, each nozzle being adapted to dispose thin layers of the component supplied thereto on the receiving surface (22; 122).

9. A device as claimed in claim 1, wherein the receiving means (15) is adapted to transfer the stratum to the second means (6, 18).

10. A device as claimed in claim 9, wherein the receiving means (15) comprises a body (17) having a conical interior circumferential surface (22) arranged concentrically about the longitudinal axis (13) and thus enclosing the layering means (8) and forming said receiving surface (22), the receiving means (15), during rotation and under the action of centrifugal forces, being adapted to convey said stratum towards the wider end (11) of the conical receiving surface (22), at which end (11) the stratum will be transferred to the second means (6, 18) in consequence of the rotation of the receiving means (15).

11. A device as claimed in claim 10, wherein the second means (6, 18) comprises a helical duct (6) which encloses the receiving means (15) and has a side open towards the receiving means (15), whereby the stratum continuously transferred from the receiving means (15) will be collected by said duct (6).

12. A device as claimed in claim 11, wherein the second means (6, 18) comprises in unison with the receiving means (15) rotatable discharge means (18), and that the duct (16) comprises an outlet connected thereto, the discharge means (18) being adapted to convey to the outlet (7) the stratum transferred to the duct (6) during deformation of its layer structure.

13. A device as claimed in claim 12, wherein each discharge means (18) comprises a vane (18) which is attached to the receiving means (15) and displaceable in the duct (6) and which during rotation of the receiving means (15) engages with the stratum transferred to the duct (6) and conveys it during simultaneous creasing thereof towards the outlet (7).

14. A device as claimed in claim 1, wherein the second means (101, 129) comprises a scraper element (129) for scraping off the stratum from the receiving surface (122), and that the receiving means (115) is adapted to transfer, during rotation thereof, the thus scraped-off stratum to a discharge unit (101) of the second means (101, 129).

15. A device as claimed in claim 14, wherein the receiving means (115) comprises a body (117) having a cylindrical interior circumferential surface (122) which is concentrically arranged about the longitudinal axis (113) and which thus encloses the layering means (108) and forms said receiving surface (122), and that the scraper element (129) is arranged along the receiving surface (122) for scraping off the stratum from the receiving surface (122), said deformation of the stratum being provided during said scraping off.

16. A device as claimed in claim 15, wherein the scraper element (129) comprises a helical band element (129) which is extended parallel with the longitudinal axis (113) and which is arranged along the cylindrical receiving surface (122), the receiving means (115) being rotatable with a second angular velocity and the band element (129) being rotatable about the longitudinal axis (113) with a third angular velocity ($\omega_{103}$) differing from said second angular velocity ($\omega_{102}$), whereby the stratum formed on the receiving surface (122), during rotation of the receiving means (122) as well as the band element (129), is continuously conveyed to a discharge position (119) from which the stratum will be transferred to the discharge unit (101) of the second means (101, 129).

17. A method for mixing at least two components, comprising the steps of joining the components in layers, and subsequently conveying the thus-joined components in such a manner that a layer structure obtained in connection with the joining is deformed to form a homogeneous mixture of components, wherein the step of joining the components comprises the steps of alternately disposing, with the aid of a layering means (8; 108), thin layers of the components on a receiving means (15; 115) radially enclosing the layering means (8; 108) to form a stratum of layer structure, and by rotation of the receiving means (15; 115) supporting the stratum, the layers in the circumferential direction being distributed uniformly on the receiving means (15; 115) in consequence of its rotation.

18. A method as claimed in claim 17, wherein the steps of rotating the layering means (8; 108) with a first angular velocity ($\omega_1$; $\omega_{101}$), and rotating the receiving means (15; 115) with an angular velocity ($\omega_2$; $\omega_{102}$) differing from the angular velocity ($\omega_1$; $\omega_{101}$) of the layering means (8; 108), whereby the layering means (8; 108) engages with said components supplied thereto and throws them in the form of thin layers to the receiving means (15; 115).

* * * * *